US008711052B2

(12) United States Patent
Lin et al.

(10) Patent No.: US 8,711,052 B2
(45) Date of Patent: Apr. 29, 2014

(54) ANTENNA SUPPORT DEVICE

(75) Inventors: Yi-Chieh Lin, Hsinchu (TW); Kun-Hsien Lee, Hsinchu (TW); Hung-Yuan Lin, Hsinchu (TW); San-Yi Kuo, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 390 days.

(21) Appl. No.: 13/151,279

(22) Filed: Jun. 2, 2011

(65) Prior Publication Data

US 2012/0212394 A1 Aug. 23, 2012

(30) Foreign Application Priority Data

Feb. 21, 2011 (TW) ..... 100105608 A

(51) Int. Cl.
*H01Q 3/02* (2006.01)

(52) U.S. Cl.
USPC ..... 343/882

(58) Field of Classification Search
USPC ..... 343/880, 878, 882, 888, 890
See application file for complete search history.

(56) References Cited

U.S. PATENT DOCUMENTS 6,697,026 B1 * 2/2004 Hemmingsen, II ..... 343/760
7,057,575 B2 * 6/2006 Malhotra ..... 343/890
8,456,376 B2 * 6/2013 Yang et al. ..... 343/882

* cited by examiner

*Primary Examiner* — Seung Lee
(74) *Attorney, Agent, or Firm* — Winston Hsu; Scott Margo

(57) ABSTRACT

An antenna support device for supporting an antenna is disclosed. The antenna support device includes a support arm, a holder mounted on the support arm, a first connecting member rotatably connected to the holder around a first axis, a second connecting member rotatably connected to the first connecting member around a second axis, and an antenna bracket fixed on the second connecting member, wherein the antenna is fixed on the antenna bracket.

19 Claims, 14 Drawing Sheets

ANTENNA SUPPORT DEVICE

BACKGROUND OF THE INVENTION

1. Field of the Invention

The invention relates to an antenna support device, and more particularly, to an antenna support device capable of adjusting antenna direction quickly and accurately.

2. Description of the Prior Art

An antenna is one of the most essential components of wireless communication devices. Different wireless communication devices may use different antennas, each having specific types and characteristics. Since transmission performance of the antenna may deeply influence the communication quality, a user needs to arrange the antenna to an appropriate position to receive and transmit signals for the excellent transmission performance. For example, during assembly of satellite antennas, elevation angle and direction of the satellite antennas should be accurately arranged to aim to the geostationary satellites for receiving the faint satellite signals. Also, during assembly of an antenna array of a Long Term Evolution (LTE) wireless communication system, each antenna of the antenna array should be installed to the corresponding position and direction to provide excellent transmission application.

In the prior art, a common antenna adjustment method is to use a universal joint for a connection device between an antenna and a holder for providing the adjustment of relative position and direction. However, the universal joint usually can not offer enough fixing capability. When a certain external force acts on the universal joint, the universal joint may turn to other direction and be unable to hold on the desired position. In such a situation, the antenna would be not suitable for use in an outdoor environment under various weather conditions by using the connection method of the universal joint. In addition, another antenna adjustment method is to use a three-axis rotation scheme for adjusting the antenna. However, the mentioned three-axis rotation scheme needs to adjust with three axis angles during assembly, resulting in complicated assembly process. On the other hand, the components of the antenna are usually assembled in the field due to its large size and transport convenient. Furthermore, the assembly environment is usually at a high place. In short, the complicated antenna adjustment method is also not suitable for the antenna used in the outdoor environment.

Therefore, designing a support device of the antenna for rapid assembly and accurate install direction should be a concern in progressive mechanism design.

SUMMARY OF THE INVENTION

It is therefore a primary objective of the claimed invention to provide an antenna support device.

An embodiment of the invention discloses an antenna support device for supporting an antenna, which includes a support arm, a holder mounted on the support arm, a first connecting member rotatably connected to the holder around a first axis, a second connecting member rotatably connected to the first connecting member around a second axis, and an antenna bracket fixed on the second connecting member, wherein the antenna is fixed on the antenna bracket.

An embodiment of the invention further discloses an antenna support device for supporting an antenna, which includes a support arm, a holder mounted on the support arm, and an antenna bracket rotatably connected to the holder around a first axis and a second axis, wherein the antenna is fixed on the antenna bracket.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
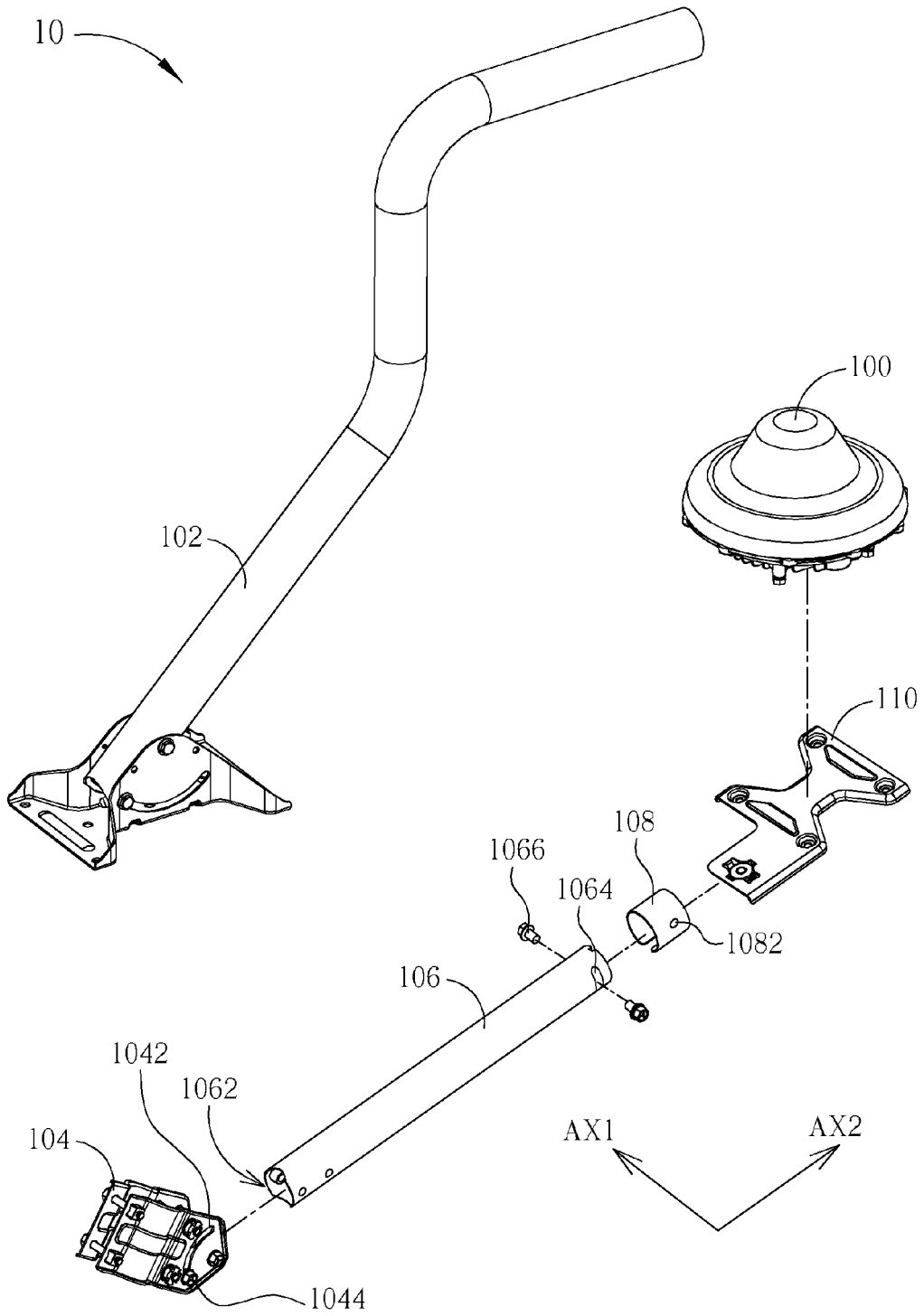
FIG. 1 is an exploded diagram of an antenna support device according to an embodiment of the invention.
Figure 2:
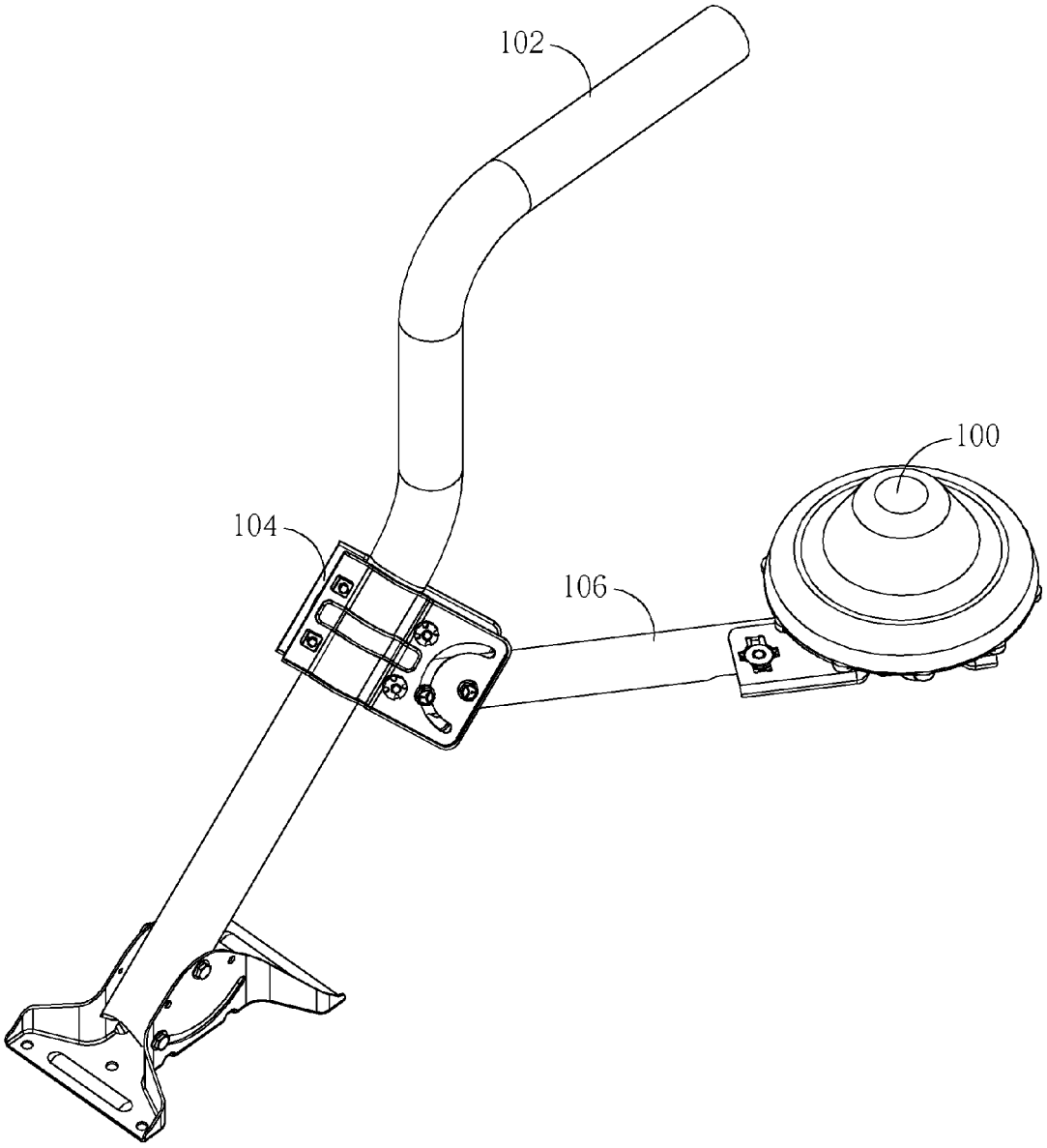
FIG. 2 is an assembly diagram of the antenna support device shown in FIG. 1 according to an embodiment of the invention.
Figure 3:
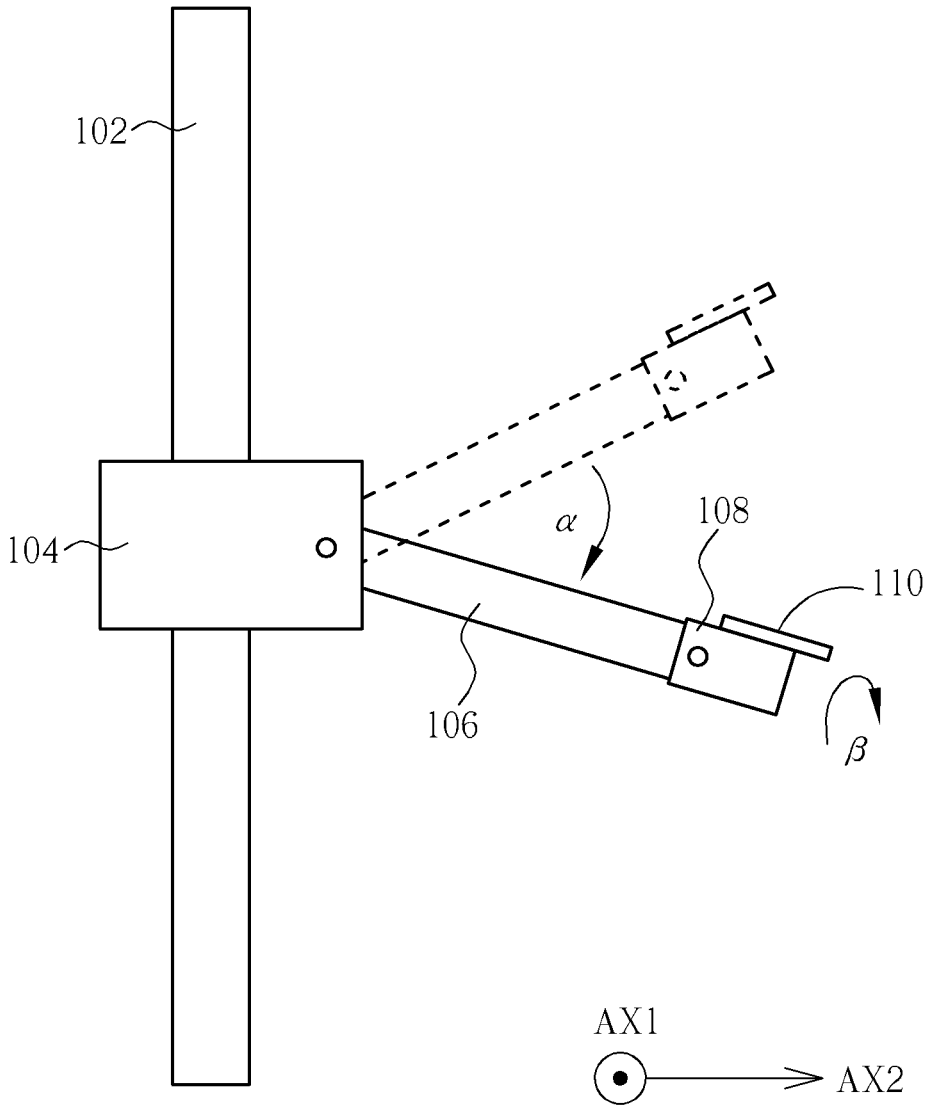
FIG. 3 is a side-view diagram of the antenna support device shown in FIG. 1 according to an embodiment of the invention.

Please refer to FIG. 1 to FIG. 3. FIG. 1 is an exploded diagram of an antenna support device 10 according to an embodiment of the invention. FIG. 2 is an assembly diagram of the antenna support device 10 according to an embodiment of the invention. FIG. 3 is a side-view diagram of the antenna support device 10 according to an embodiment of the invention. The antenna support device 10 is utilized for supporting an antenna 100. As shown in FIG. 1, the antenna support device 10 includes a support arm 102, a holder 104, connecting members 106 and 108, and an antenna bracket 110. The holder 104 is mounted on the support arm 102. The connecting member 106 can be rotatably connected, around an axis AX1, to the holder 104. The connecting member 108 can be rotatably connected, around an axis AX2, to the connecting member 106. Preferably, the axis AX1 is different from the axis AX2. The antenna bracket 110 is fixed on the connecting members 108. The antenna 100 is fixed on the antenna bracket 110. As shown in FIG. 2, a user can quickly assemble all of the components of the antenna support device 10. As a result, the antenna 100 can be firmly fastened on the support arm 102. Moreover, through adjusting the connecting members 106 and 108 in a rotatable manner, the antenna 100 can also be arrange to the desired position and angle for transmitting/receiving signals. In brief, the antenna support device 10 is capable of accurately arranging the antenna 100 to the required direction via simple rotation operation for more rapid and stable assembly.

Further description associated with the assembly of the antenna support device 10 follows. As shown in FIG. 3, when the connecting members 106 is installed on the holder 104, the connecting members 106 can be rotated around the axis AX1 (e.g. rotated by $\alpha$ degrees around the axis AX1) for the desired direction, and connected to the holder 104. Similarly, when the connecting members 108 is installed on the connecting members 106, the connecting members 108 can be rotated around the axis AX2 (e.g. rotated by β degrees around the axis AX2) for the desired direction, and connected to the connecting members 106. As the axis AX1 is not parallel to the axis AX2, for example, the axis AX1 is perpendicular to the axis AX2, relative position of the antenna 100 can be adjusted around two axis direction, and therefore, to the most appropriate position for signal transmission and reception.

Figure 4:
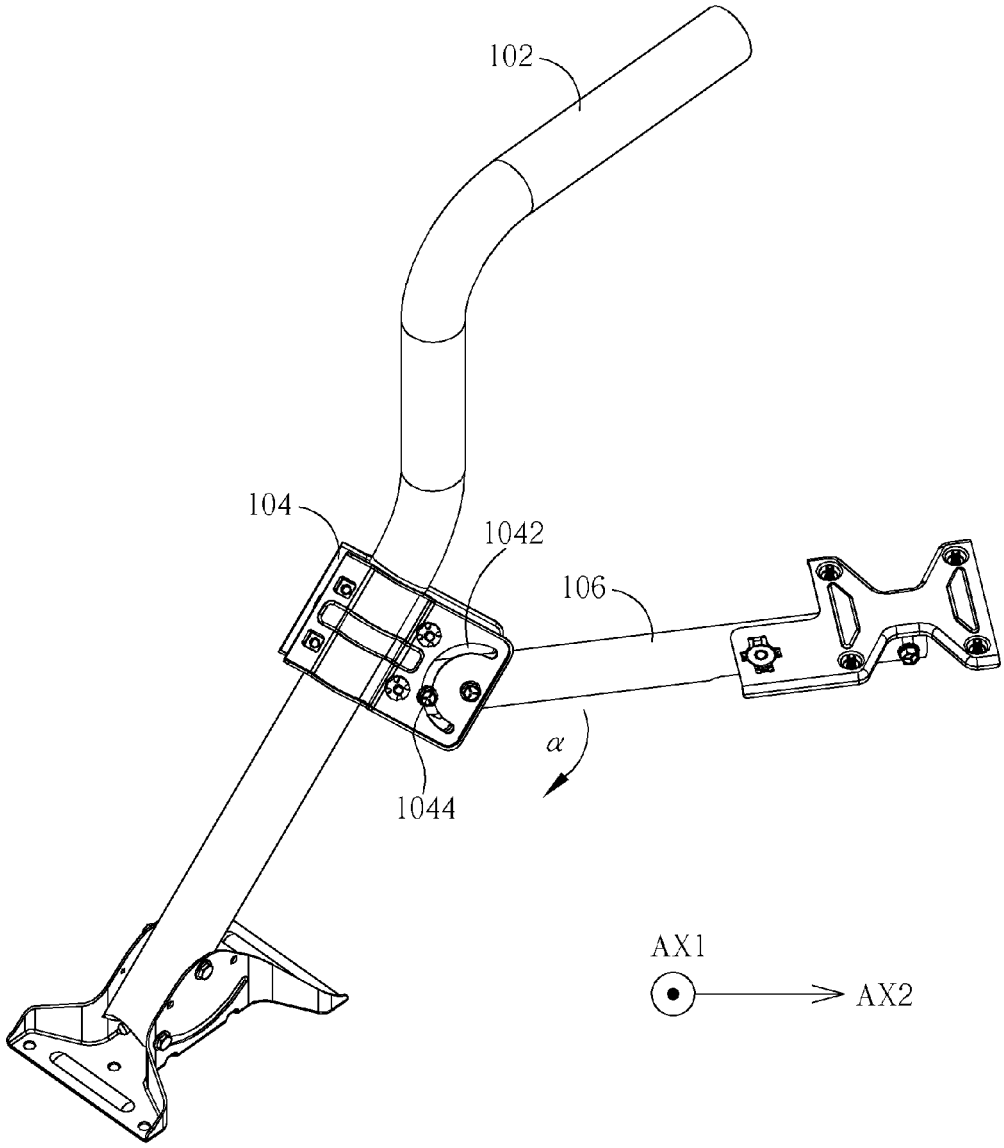
FIG. 4 and FIG. 5 are schematic diagrams of assembling the antenna support device according to embodiments of the invention, respectively.
Figure 5:
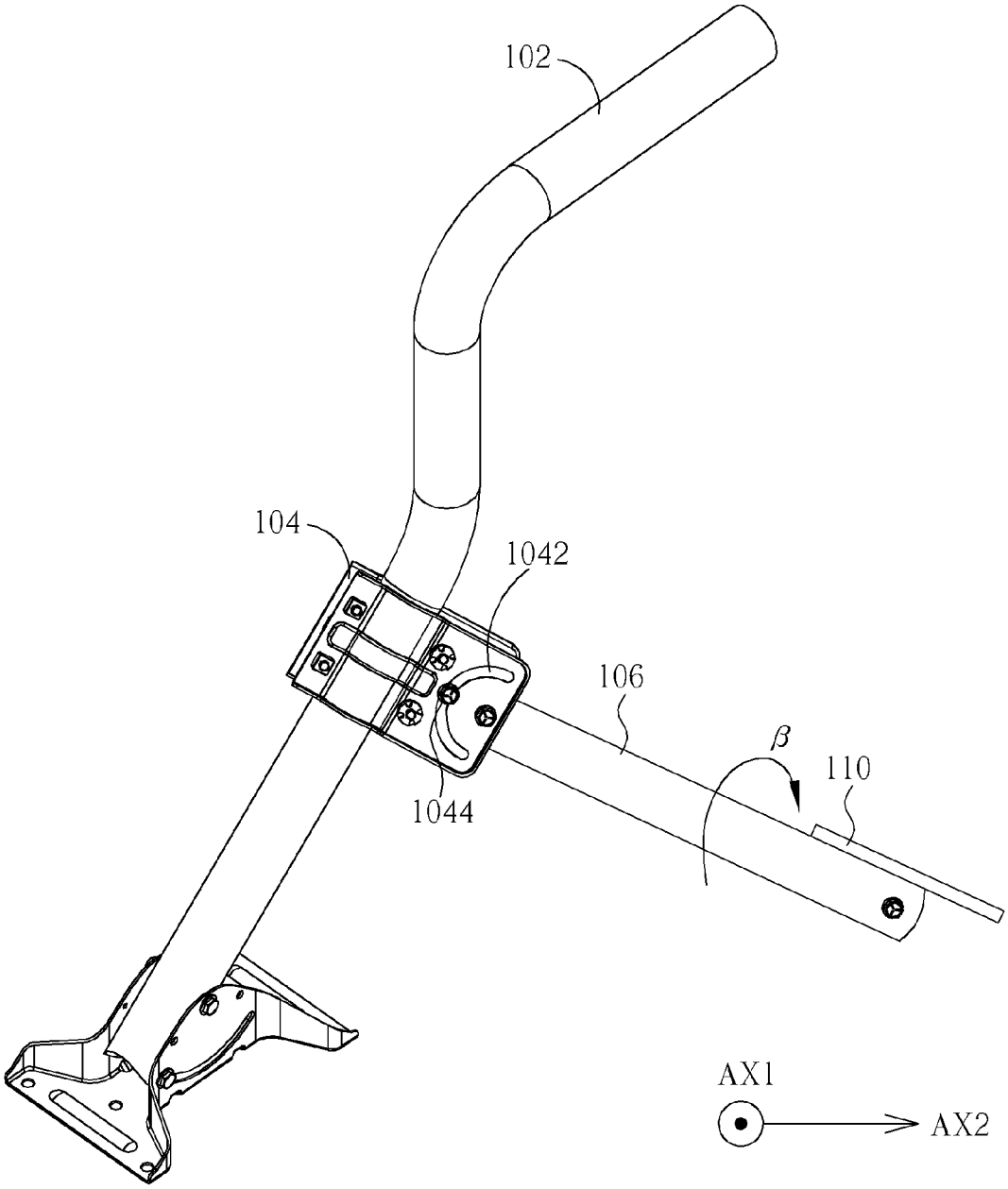

Please further refer to FIG. 1. The holder 104 further includes an arc slot 1042 and a positioning component 1044. The connecting member 106 further includes a connecting part 1062, an arc slot 1064, and a positioning component 1066. The connecting member 108 further includes a connecting part 1082. Moreover, as to the assembly operation of the antenna support device 10, please refer to FIG. 4 and FIG. 5, which are schematic diagrams of assembling the antenna support device according to embodiments of the invention, respectively. As shown in FIG. 4, the holder 104 is fixed on the support arm 102 first. After that, the positioning component 1044 can pass through the connecting part 1062 of the connecting member 106 and the arc slot 1042 of the holder 104 for connecting the connecting member 106 to the holder 104, and the positioning component 1044 can position relative position between the holder 104 and the connecting member 106 along the arc slot 1042 so that the connecting member 106 can rotatably move around the axis AX1 to adjust the relative position with the holder accordingly. As a result, the connecting member 106 can be rotatably adjusted around the axis AX1 to the desired angle (e.g. the connecting member 106 can be rotated by a degrees around the axis AX1). Furthermore, as shown in FIG. 5, the positioning component 1066 can pass through the connecting part 1082 of the connecting member 108 and the arc slot 1064 of the connecting member 106 for connecting the connecting member 108 to the connecting member 106, and the positioning component 1066 can position relative position between the connecting member 106 and the connecting member 108 along the arc slot 1064 so that the connecting member 108 can rotatably move around the axis AX2 to adjust the relative position with the connecting member 106 accordingly. This means, the connecting member 108 can be rotatably adjusted around the axis AX2 to the desired angle (e.g. the connecting member 108 can be rotated by β degrees around the axis AX2). Therefore, the antenna 100 disposed on the antenna bracket 110 can be adjusted to the desired position and angle accordingly.

Figure 6:
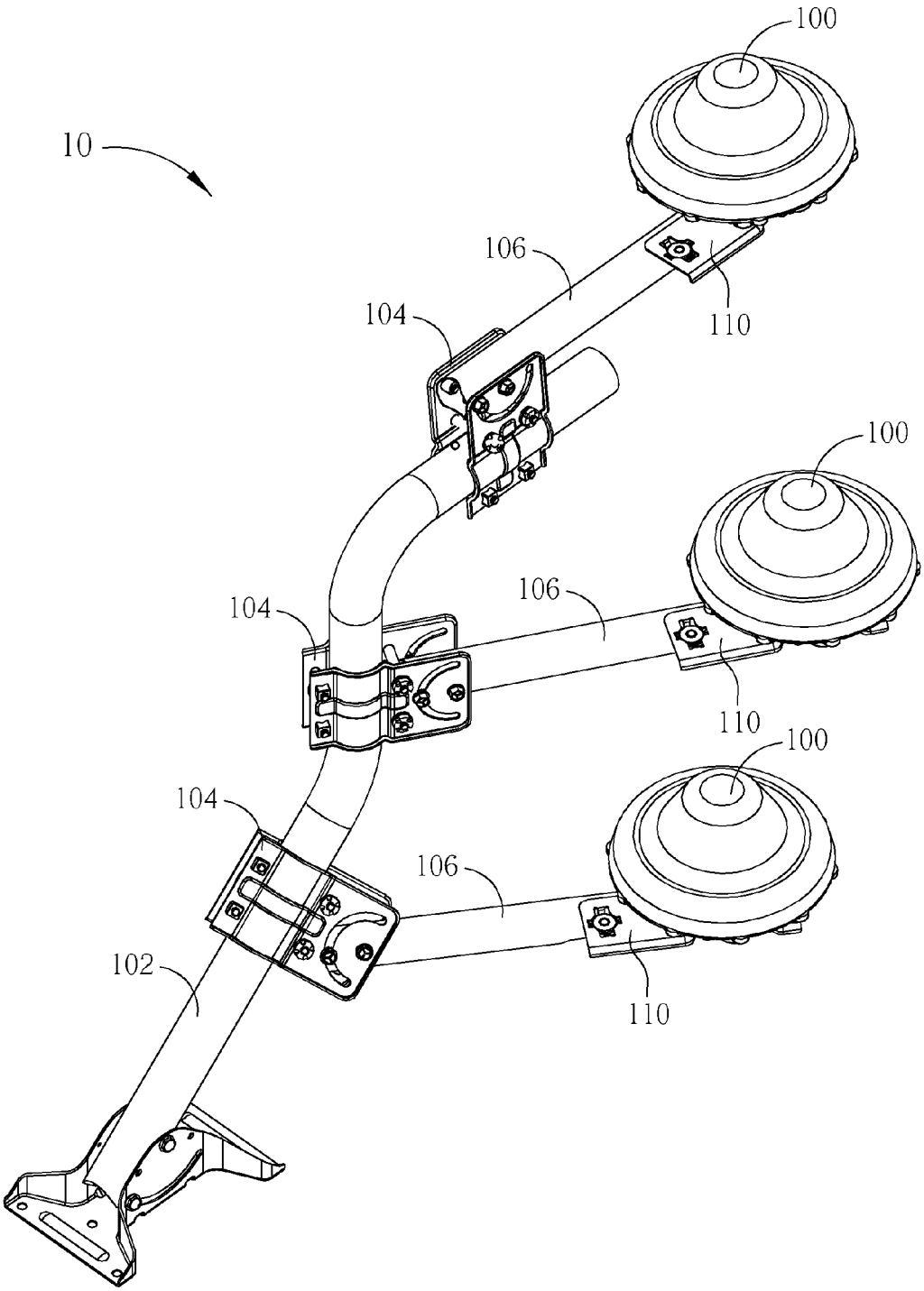
FIG. 6 is a schematic diagram of the antenna support device applying in an antenna system having multiple antennas according to an embodiment of the invention.

Please note that the antenna support device of the invention is capable of being applied in various antennas or antenna array systems, such as satellite antennas, Long Term Evolution (LTE) antennas, and those skilled in the art can make alternations and modifications accordingly. Take an LTE antenna array of an LTE wireless communication system as an example, LTE antennas AT1~AT3 shown in FIG. 6 are adjusted to face different directions for realizing a multiple-input multiple-output (MIMO) antenna array. Therefore, during assembling in an outdoor environment, each antenna is capable of being installed on the desired direction rapidly and accurately by using the design of the antenna support device 10 for realizing the whole assembly requirement.

Figure 7:
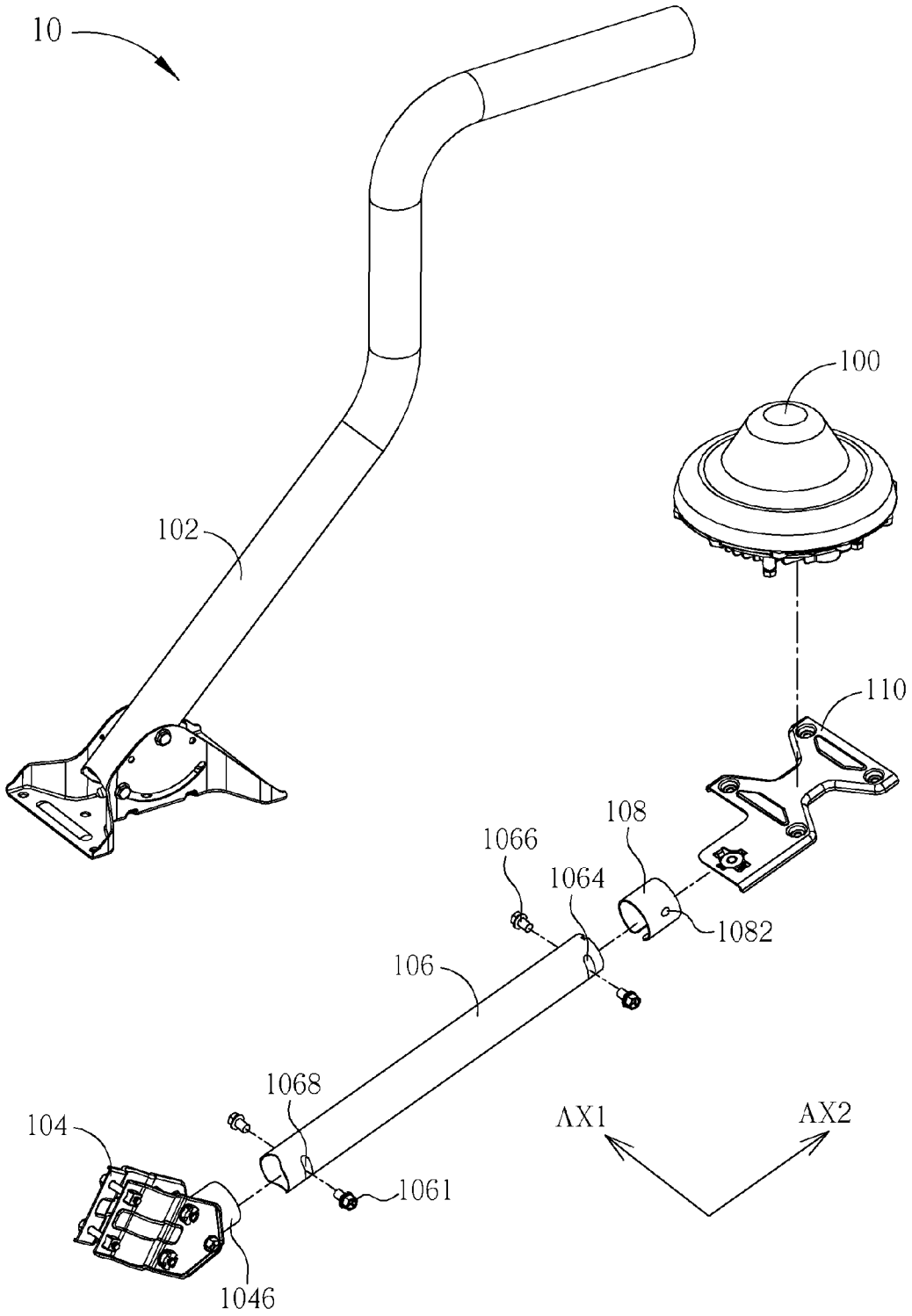
FIG. 7 to FIG. 9 are schematic diagrams of the connection types between both connecting members shown in FIG. 1 and between the holder and the connecting member shown in FIG. 1 according to alternative embodiments of the invention.
Figure 8:
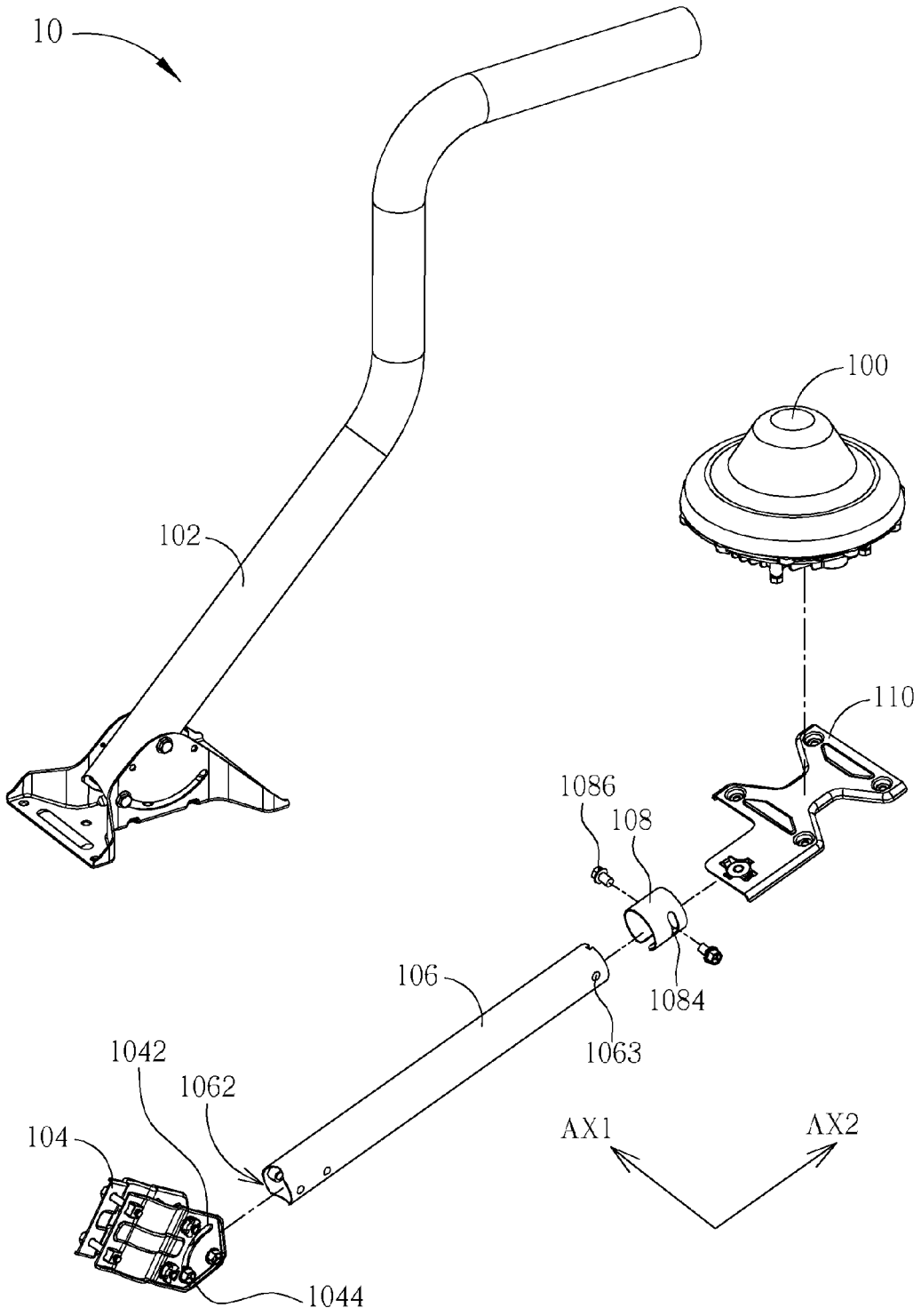
Figure 9:
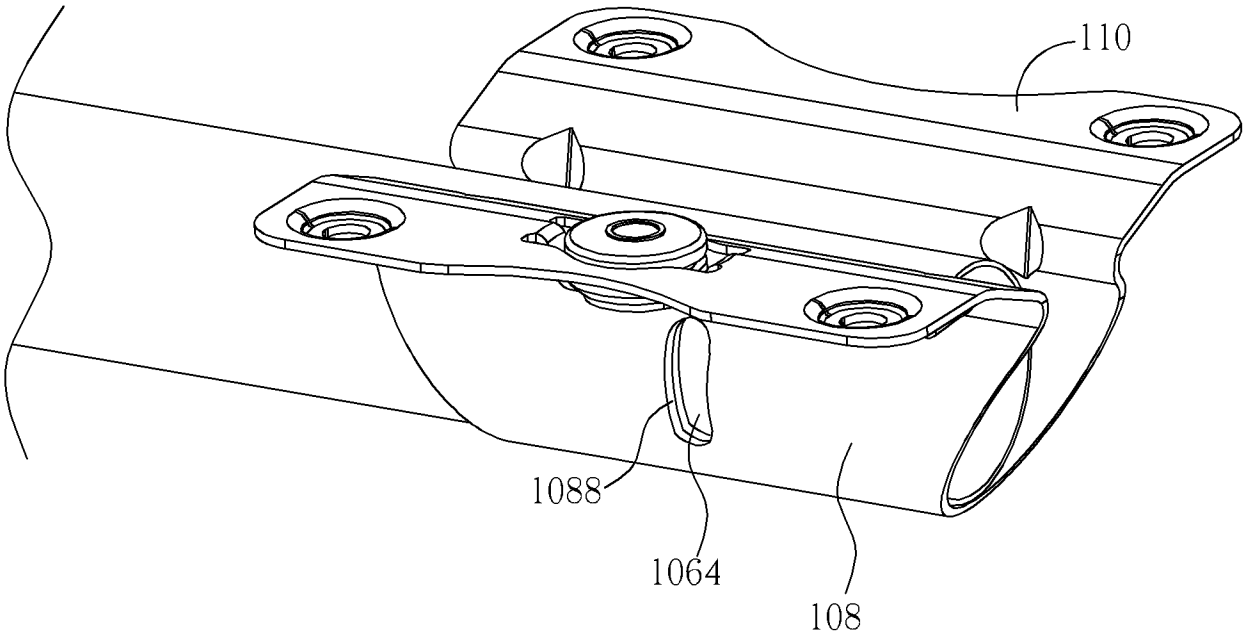

On the other hand, please refer to FIG. 7 to FIG. 9 are schematic diagrams of the connection types of the components of the antenna support device 10 shown in FIG. 1 according to alternative embodiments of the invention. As shown in FIG. 7, the holder 104 further includes a connecting part 1046. The connecting member 106 further includes an arc slot 1068 and a positioning component 1061. Similarly, the positioning component 1061 can pass through the connecting part 1046 of the holder 104 and the arc slot 1068 of the connecting member 106 so that the connecting member 106 can also be rotatably connected, around the axis AX1, to the holder 104. As shown in FIG. 8, the connecting member 106 further includes a connecting part 1063. The connecting member 108 further includes an arc slot 1084 and a positioning component 1086. Similarly, the positioning component 1086 can pass through the connecting part 1063 of the connecting member 106 and the arc slot 1084 of the connecting member 108, and the connecting member 108 can be rotatably connected, around the axis AX2, to the connecting member 106. In addition, the connection between the holder 104 and connecting member 106 or the connection between the connecting member 106 and the connecting member 108 can also be realized by using arc slot design. For example, as shown in FIG. 9, the connecting member 108 further includes an auxiliary arc slot 1088. The positioning component 1066 can pass through the auxiliary arc slot 1088 and the arc slot 1064 of the connecting member 108 to position the relative position between the connecting member 106 and the connecting member 108 for rotatably adjustment purpose. Such like this, connecting member 106 can also be connected to the holder 104 with the arc slot design, and further description omitted for brevity.

Figure 10:
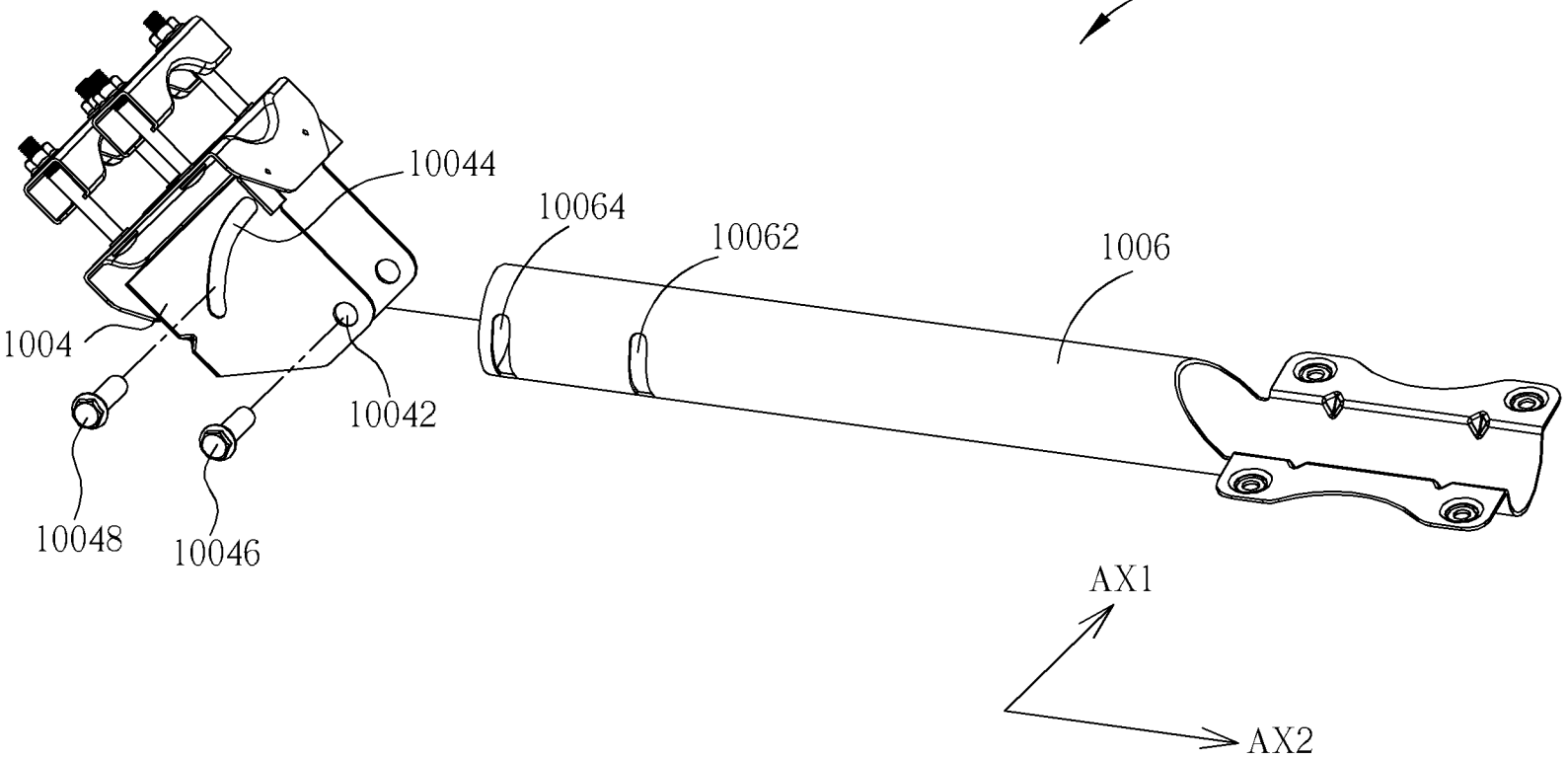
FIG. 10 and FIG. 11 are exploded diagrams of an antenna support device according to embodiments of the invention, respectively.

Please refer to FIG. 10, which is an exploded diagram of an antenna support device 1000 according to an embodiment of the invention. The antenna support device 1000 includes a support arm 1002, a holder 1004, and an antenna bracket 1006. Please note that the units in the antenna support device 1000 shown in FIG. 10 with the same designations as those in the antenna support device 10 shown in FIG. 1 have similar operations and functions, and further description is omitted for brevity. The interconnections of the units are as shown in FIG. 10. Different from the antenna support device 10, the antenna support device 1000 omits the connecting members. The holder 1004 further includes a connecting part 10042, an arc slot 10044, and positioning components 10046 and 10048. The antenna bracket 1006 further includes an arc slot 10062 and an auxiliary arc slot 10064. The positioning component 10046 can pass through the connecting part 10042 and the arc slot 10062 for connecting the antenna bracket 1006 to the holder 1004, and the antenna bracket 1006 can also be rotatably adjusted around the axis AX2 to the desired angle by the position adjustment of the positioning component 10046 along the arc slot 10062. Moreover, the positioning component 10048 can pass through the arc slot 10044 and the arc slot 10064, and the antenna bracket 1006 can also be rotatably adjusted around the axis AX1 to the desired angle by the position adjustment of the positioning component 10048 along the auxiliary arc slot 10064. As a result, an antenna 1008 (not shown in FIG. 10) will be adjusted to the desired position and angle accordingly. Such like this, the holder 1004 can also include an arc slot and an auxiliary arc slot, and the antenna bracket 1006 can also include an arc slot and a positioning component. Similarly, the antenna can also be adjusted to the required position according to the similar operation as mentioned above, and further description omitted for brevity.

Figure 11:
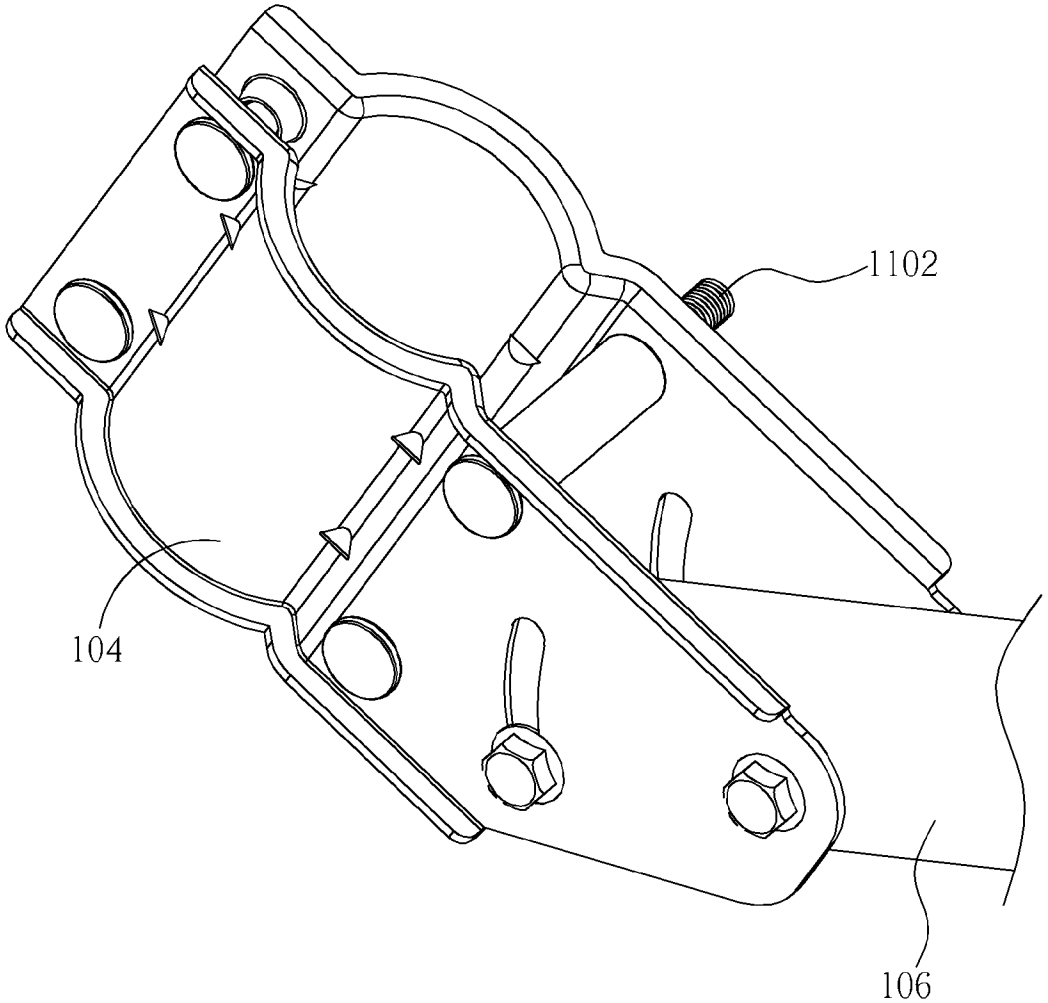

In addition, a limiting component design can be introduced for the holder 104 to ensure that the connecting member or the antenna bracket is capable of being connected to the holder 104 and adjusted in a rotatable manner after the holder 104 is fixed on the support arm 102. As a result, the antenna bracket 110 can be rotatably adjusted when the holder 104 is fixed on the support arm 102. For example, please refer to FIG. 11. As shown in FIG. 11, the holder 104 of the antenna support devices 10 further includes a limiting component 1102. Through the position limiting of the limiting component 1102, the holder 104 will reserve enough space for rotation adjustment with connected element after connecting to the support arm 102. Preferably, the limiting component 1102 can be a limiting screw, a limiting bush, a limiting rivet, or any apparatus which can provide the limiting purpose.

Figure 12:
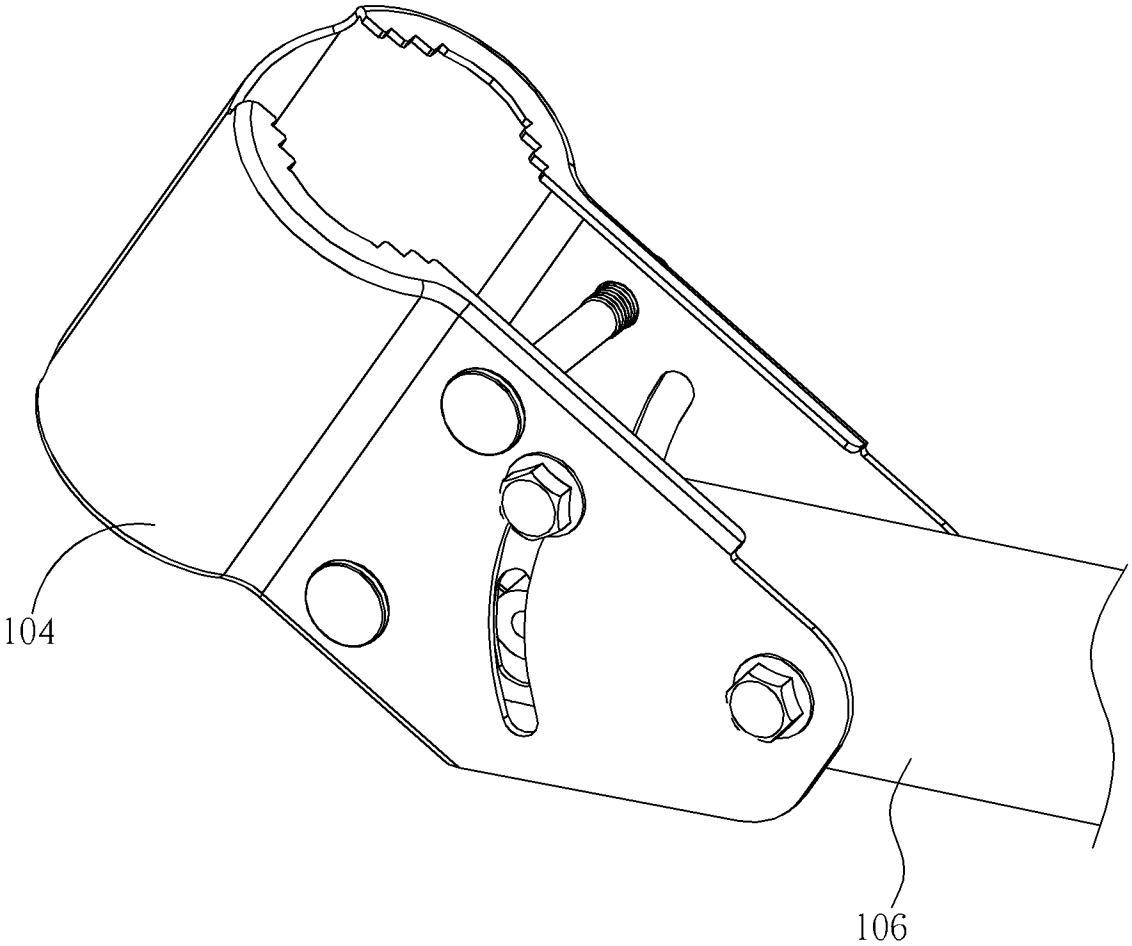
FIG. 12 to FIG. 14 are schematic diagrams of connection types of the holder and the support arm shown in FIG. 1 according to alternative embodiments of the invention, respectively.
Figure 13:
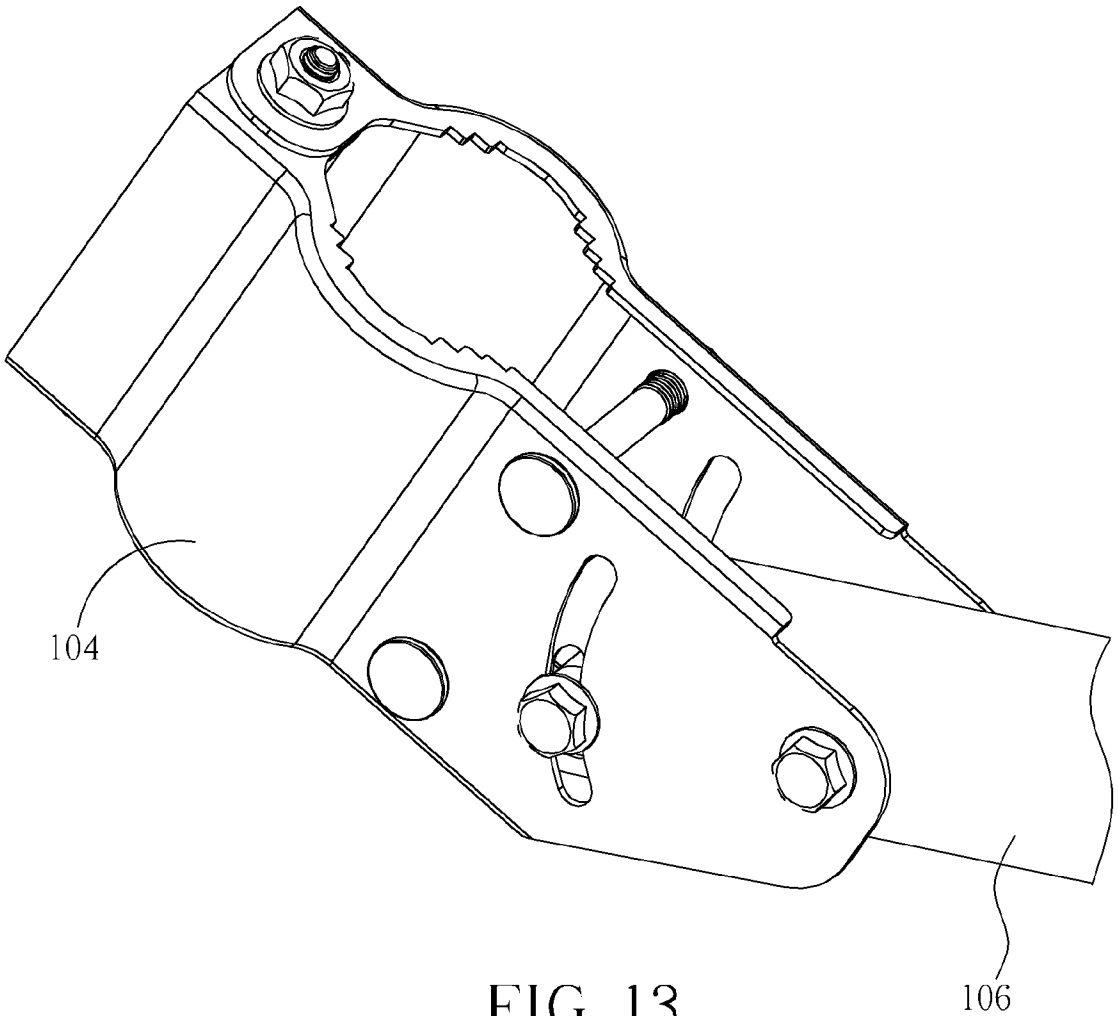
Figure 14:
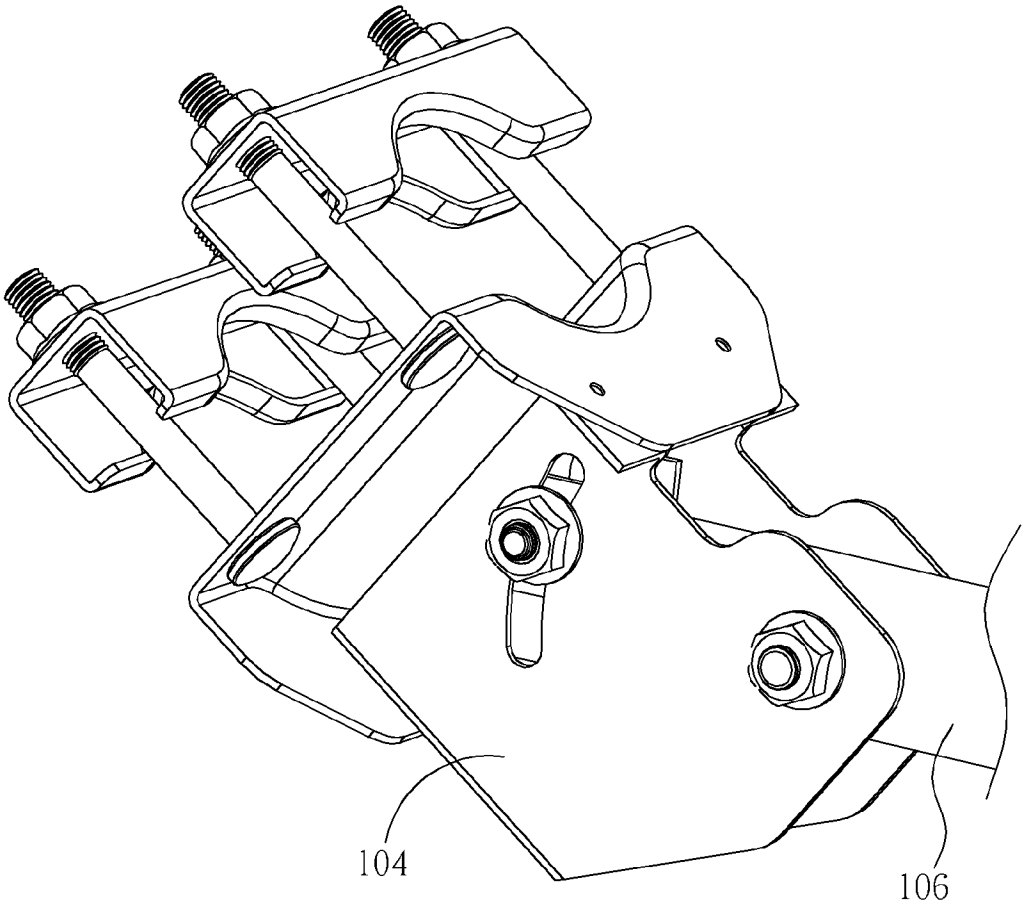

Note that the antenna support devices 10 and 1000 are exemplary embodiments of the invention, and those skilled in the art can make alternations and modifications accordingly. For example, as shown in FIG. 12 to FIG. 14, the holder 104 can be fixed on the support arm 102 with soldering, screwing, detachable or any other fixing method. Besides, the holder 104 and the support arm 102 can also be formed as a monolithic structure. In addition, any amount of the above-mentioned arc slot or auxiliary arc slot which its center is positioned on an axial lead of the corresponding axis is suitable.

In summary, the antenna support device of the invention can provide simple assembly of the antenna and is capable of accurately arranging the antenna to the desired direction via simple rotation operation for more rapid and stable assembly.

Those skilled in the art will readily observe that numerous modifications and alterations of the device and method may be made while retaining the teachings of the invention.

What is claimed is:

1. An antenna support device for supporting an antenna, comprising:

a support arm;

a holder mounted on the support arm, the holder comprising a first auxiliary arc slot;

a first connecting member rotatably connected to the holder around a first axis, the first connecting member comprising a first arc slot and a first positioning component;

a second connecting member rotatably connected to the first connecting member around a second axis; and an antenna bracket fixed on the second connecting member, wherein the antenna is fixed on the antenna bracket, wherein the first positioning component passes through the first auxiliary arc slot and the first arc slot for connecting the first connecting member to the holder, and the first positioning component positions relative position between the holder and the first connecting member along the first arc slot and the first auxiliary arc slot so that the first connecting member rotatably moves around the first axis to adjust the relative position with the holder accordingly.

2. The antenna support device of claim 1, wherein the holder comprises a second arc slot and a second positioning component, and the first connecting member comprises a first connecting part, wherein the second positioning component passes through the first connecting part and the second arc slot for connecting the first connecting member to the holder, and the second positioning component positions relative position between the holder and the first connecting member along the second arc slot so that the first connecting member rotatably moves around the first axis to adjust the relative position with the holder accordingly.

3. The antenna support device of claim 1, wherein the holder comprises a first connecting part, and the first connecting member comprises a second arc slot and a second positioning component, wherein the second positioning component passes through the first connecting part and the second arc slot for connecting the first connecting member to the holder, and the second positioning component positions relative position between the holder and the first connecting member along the second arc slot so that the first connecting member rotatably moves around the first axis to adjust the relative position with the holder accordingly.

4. The antenna support device of claim 1, wherein the first connecting member comprises a second connecting part, and the second connecting member comprises a second arc slot and a second positioning component, wherein the second positioning component passes through the second connecting part and the second arc slot for connecting the second connecting member to the first connecting member, and the second positioning component positions relative position between the first connecting member and the second connecting member along the second arc slot so that the second connecting member rotatably moves around the second axis to adjust the relative position with the first connecting member accordingly.

5. The antenna support device of claim 1, wherein the first connecting member comprises a second arc slot and a second positioning component, and the second connecting member comprises a second connecting part, wherein the second positioning component passes through the second connecting part and the second arc slot for connecting the second connecting member to the first connecting member, and the second positioning component positions relative position between the first connecting member and the second connecting member along the second arc slot so that the second connecting member rotatably moves around the second axis to adjust the relative position with the first connecting member accordingly. member and the antenna bracket are monolithically formed.

6. The antenna support device of claim 1, wherein the second connecting member and the antenna bracket are monolithically formed.

7. The antenna support device of claim 1, wherein the first axis is different from the second axis.

8. The antenna support device of claim 1, wherein the first axis is perpendicular to the second axis.

9. The antenna support device of claim 1, the holder further comprises a limiting component for ensuring that the first connecting member is capable of being adjusted in a rotatable manner when the holder is mounted on the support arm.

10. An antenna support device for supporting an antenna, comprising:

a support arm;

a holder mounted on the support arm;

a first connecting member rotatably connected to the holder around a first axis, the first connecting member comprising a second auxiliary arc slot;

a second connecting member rotatably connected to the first connecting member around a second axis, the second connecting member comprising a second arc slot and a second positioning component; and an antenna bracket fixed on the second connecting member, wherein the antenna is fixed on the antenna bracket;

wherein the second positioning component passes through the second auxiliary arc slot and the second arc slot for connecting the second connecting member to the first connecting member, and the second positioning component positions relative position between the first connecting member and the second connecting member along the second arc slot and the second auxiliary arc slot so that the second connecting member rotatably moves around the second axis to adjust the relative position with the first connecting member accordingly.

11. An antenna support device for supporting an antenna, comprising:

a support arm;

a holder mounted on the support arm, the holder comprising a second arc slot and a second positioning component; and an antenna bracket rotatably connected to the holder around a first axis and a second axis, the antenna bracket comprising a first auxiliary arc slot, wherein the antenna is fixed on the antenna bracket;

wherein the second positioning component passes through the first auxiliary arc slot and the second arc slot for connecting the antenna bracket to the holder, and the second positioning component positions relative position between the antenna bracket and the holder along the second arc slot so that the antenna bracket rotatably moves around the second axis to adjust the relative position with the holder accordingly.

12. The antenna support device of claim 11, wherein the antenna bracket comprises a first arc slot and a first positioning component, and the holder comprises a first connecting part, wherein the first positioning component passes through the first connecting part and the first arc slot for connecting the antenna bracket to the holder, and the first positioning component positions relative position between the holder and the antenna bracket along the first arc slot so that the antenna bracket rotatably moves around the first axis to adjust the relative position with the holder accordingly.

13. The antenna support device of claim 12, wherein both of the centers of the first arc slot and the first auxiliary arc slot are positioned on an axial lead of the first axis.

14. The antenna support device of claim 11, wherein the antenna bracket comprises a first connecting part, and the holder comprises a first arc slot and a first positioning component, wherein the first positioning component passes through the first connecting part and the first arc slot for connecting the antenna bracket to the holder, and the first positioning component positions relative position between the holder and the antenna bracket along the first arc slot so that the antenna bracket rotatably moves around the first axis to adjust the relative position with the holder accordingly.

15. The antenna support device of claim 11, wherein the first axis is different from the second axis.

16. The antenna support device of claim 11, wherein the first axis is perpendicular to the second axis.

17. The antenna support device of claim 11, the holder further comprises a limiting component for ensuring that the antenna bracket is capable of being adjusted in a rotatable manner when the holder is mounted on the support arm.

18. An antenna support device for supporting an antenna, comprising:

a support arm;

a holder mounted on the support arm, the holder comprising a first auxiliary arc slot; and an antenna bracket rotatably connected to the holder around a first axis and a second axis, the antenna bracket comprising a second arc slot and a second positioning component, wherein the antenna is fixed on the antenna bracket;

wherein the second positioning component passes through the first auxiliary arc slot and the second arc slot for connecting the antenna bracket to the holder, and the second positioning component positions relative position between the antenna bracket and the holder along the second arc slot so that the antenna bracket rotatably moves around the second axis to adjust the relative position with the holder accordingly.

19. The antenna support device of claim 18, wherein both of the centers of a first arc slot of the holder and the first auxiliary arc slot are positioned on an axial lead of the first axis.

* * * * *